US007785025B2

(12) United States Patent
Harris

(10) Patent No.: US 7,785,025 B2
(45) Date of Patent: Aug. 31, 2010

(54) POINT OF SALE PRINTER INCLUDING AN AUTOMATED COVER OPENING APPARATUS

(75) Inventor: Richard H. Harris, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 537 days.

(21) Appl. No.: 11/847,402

(22) Filed: Aug. 30, 2007

(65) Prior Publication Data

US 2009/0060620 A1 Mar. 5, 2009

(51) Int. Cl.
*B41J 29/02* (2006.01)

(52) U.S. Cl. ..... 400/691; 400/692; 400/693; 400/358; 400/648; 400/350; 347/222

(58) Field of Classification Search ..... 400/182, 400/358, 648, 650, 659, 670.2, 691, 692, 400/693; 347/220, 221, 222; 235/1 D, 28, 235/475

See application file for complete search history.

(56) References Cited

U.S. PATENT DOCUMENTS 6,361,231 B1 * 3/2002 Sato et al. ..... 400/621
6,491,459 B2 * 12/2002 Hosomi ..... 400/613
6,565,273 B2 * 5/2003 Yamada ..... 400/512
6,715,948 B2 * 4/2004 Morita et al. ..... 400/621
6,789,969 B2 * 9/2004 Hirabayashi et al. ..... 400/693

* cited by examiner

*Primary Examiner*—Ren Yan
*Assistant Examiner*—Matthew G Marini
(74) *Attorney, Agent, or Firm*—Cantor Colburn LLP; Jason O. Piche

(57) ABSTRACT

A point of sale printer includes a housing, a cover, a first biasing member communicating with the housing and the cover, a thermal print head including a cover detent feature, the cover detent feature secures the cover to the housing, a platen and a platen drive roller which co-rotate with each other attached to the cover, a drive motor including a drive roller attached to the housing, a link member rotatably attached to the drive motor, the link member configured to rotate about a rotational axis of the drive motor and an idler roller rotatably connected to a second end of the link member, the idler roller configured to contact the platen drive roller and the drive roller, wherein a rotational direction of the drive motor corresponds to a rotational direction of the link member and also corresponds to an elevation of the idler roller which releases the cover.

8 Claims, 2 Drawing Sheets

POINT OF SALE PRINTER INCLUDING AN AUTOMATED COVER OPENING APPARATUS

TRADEMARKS

IBM® is a registered trademark of International Business Machines Corporation, Armonk, N.Y., U.S.A. Other names used herein may be registered trademarks, trademarks or product names of International Business Machines Corporation or other companies.

BACKGROUND OF THE INVENTION

1. Field of the Invention

This invention relates generally to a point of sale ("POS") printer, and more particularly, to a POS printer including an automated cover opening apparatus.

2. Description of the Background

POS printers have typically been used to print sales receipts. A recent trend in the use of such printers is an increased acceptance of thermal printing methods, which provide for operation of the printers at much faster printing speeds. While faster printing speeds allow for an increase in throughput in a checkout process, the faster printing speeds tends to result in an increased frequency in which paper supply rolls must be replaced since more information can be added to the receipt. Therefore, opening a paper supply roll access cover to re-load a paper supply roll is a frequent task.

To address this issue, POS printer manufacturers have attempted to differentiate themselves from their competitors by providing features on POS printers that simplify a paper supply roll loading process. For example, many manufacturers have introduced POS printers with push-buttons that release elaborate latching mechanisms which open a paper supply roll access cover. However, although these elaborate latching mechanisms may simplify the paper supply roll loading process, these latching mechanisms add considerable cost and complexity to the POS printers.

Simpler and less expensive methods, such as cover detents, have also been used in order to secure the paper supply roll access cover to the POS printer. However, the cover detents are difficult to use, since a force required to open the paper access cover may exceed a weight of the POS printer, especially in single station printers. Therefore, what is needed is a simpler and less expensive feature for a POS printer which is used to open the paper access cover.

SUMMARY OF THE INVENTION

The shortcomings of the prior art are overcome and additional advantages are provided by a point of sale ("POS") printer including an automated cover opening apparatus, the POS printer includes a housing defining a cavity, a cover including a first end and a second end, the first end of the cover pivotally coupled to the housing, a first biasing member in operable communication with the housing and the cover, the first biasing member biasing the cover in a direction toward an open state, a shaft rotatably connected to the second end of the cover, a thermal print head including a heat sink, a cover detent feature and a second biasing member, the cover detent feature secures the cover to the housing in a closed state and the second biasing member biasing the cover detent feature, a platen attached to the shaft, a platen drive roller attached to the second end of the shaft such that the platen drive roller co-rotates with the platen, a drive motor including a drive shaft having a rotational axis, the drive motor fixedly secured within the cavity of the housing, a drive roller attached to the drive shaft of the drive motor, a link member including a first end and a second end, the first end of the link member rotatably attached to the drive shaft, a link member configured to rotate about the rotational axis of the drive motor and an idler roller rotatably connected to the second end of the link member, the idler roller configured to be in physical communication with the platen roller and the platen drive roller, wherein a rotational direction of the drive shaft corresponds to a rotational direction of the link member, which in turn, corresponds to an elevation of the idler roller which allows the platen to force the cover detent feature to release the cover as the platen roller rotates against the thermal print head and the heat sink.

Additional features and advantages are realized through the techniques of the present invention. Other embodiments and aspects of the invention are described in detail herein and are considered a part of the claimed invention. For a better understanding of the invention with advantages and features, refer to the description and to the drawings.

TECHNICAL EFFECTS

As a result of the summarized invention, technically we have achieved a solution with a point of sale ("POS") printer including an automated cover opening apparatus, which provides a simpler and less expensive method to open the paper access cover and a method which can easily identify a POS printer requiring attention.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF SPECIFIC EMBODIMENTS

According to exemplary embodiments, a point of sale ("POS") printer including an automated cover opening apparatus opens a cover of the POS printer by simply reversing a rotational direction of the POS printer's drive motor. The automated cover opening apparatus includes an idler roller rotatably connected to a first end of a link member. A second end of the link member is rotatably connected to the drive motor. The POS printer includes housing to which a first end of the cover is pivotally coupled. A platen and platen drive roller are rotatably connected to a second end of the cover. The automated cover opening apparatus is configured such that a rotation of the platen drive roller and the platen correspond to a rotation of the drive motor. Furthermore, a rotational direction of the drive motor corresponds to a rotation of the link member, and thereby an elevation of the idler roller, which, in turn, opens the cover of the POS printer.

Figure 1:
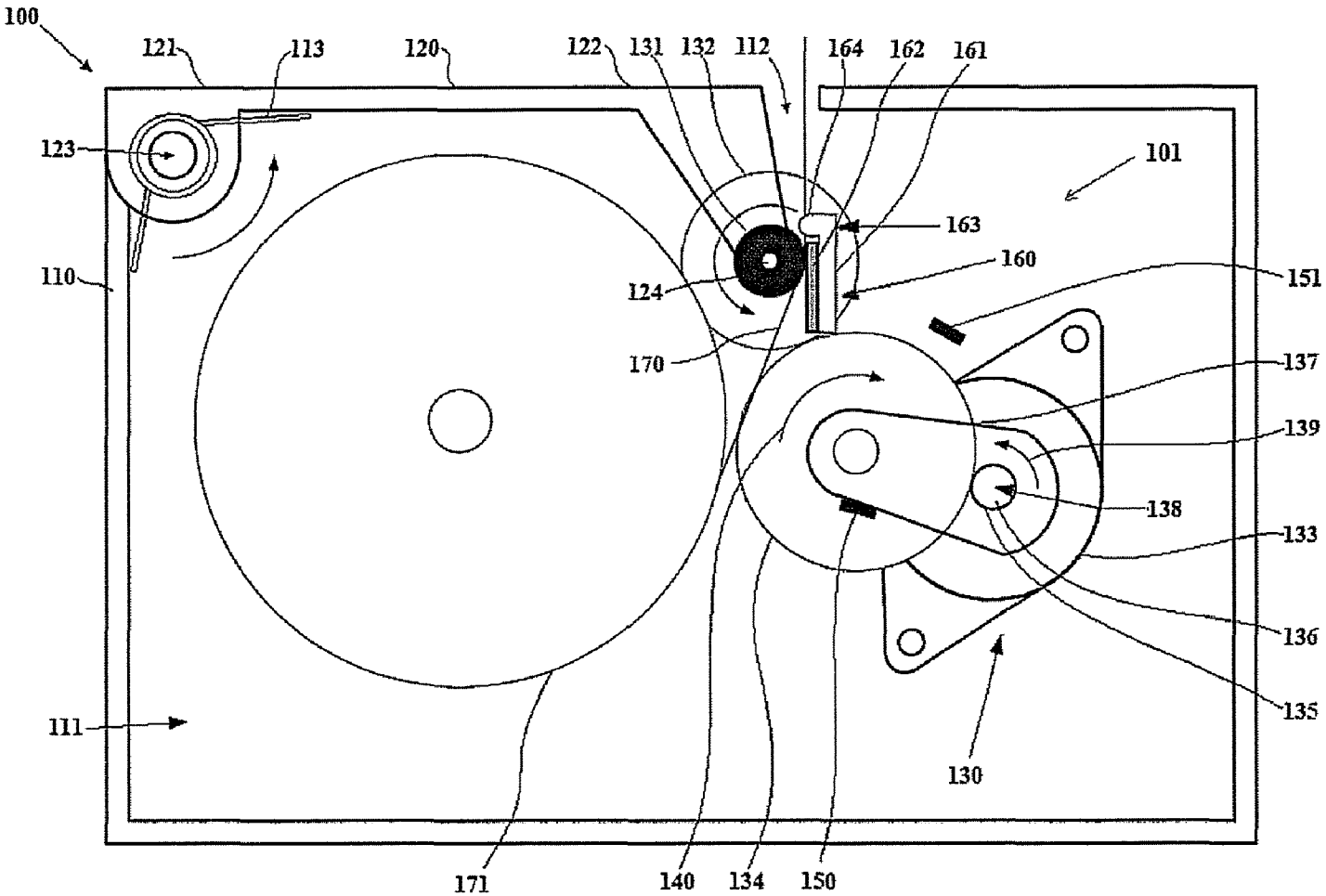
FIG. 1 is a partial cross-sectional schematic diagram illustrating a side view of an exemplary embodiment of a point-of-sale ("POS") printer including an automated cover opening apparatus, in a closed state, in accordance with the present invention.

FIG. 1 is a partial cross-sectional schematic diagram illustrating a side view of an exemplary embodiment of a POS printer 100 including an automated cover opening apparatus 101. The automated cover opening apparatus 101 for the POS printer 100 includes a housing 110 which defines a cavity 111 and a cover 120 having a first end 121 and an opposite second end 122. The automated cover opening apparatus 101 for the POS printer 100 further includes a drive system assembly 130 disposed within the cavity 111, first and second stops 150 and 151 positioned apart from each other and attached to the housing 110 within the cavity 111 and a thermal print head/heat sink assembly 160 disposed adjacent to the second end 122 of the cover 120.

The first end 121 of the cover 120 is pivotally coupled to the housing 110 so that the cover 120 may rotate, with respect to a cover pivot 123, between an open state and a closed state. FIG. 1 illustrates the cover 120 in a closed state. The closed state refers to a condition when the second end 122 of the cover 120 is securely fastened to the housing 110. Whereas, the open state refers to a condition when the second end 122 of the cover 120 is not securely fastened to the housing 110, as in FIG. 2. In the closed state, the cover 120 provides a means for enclosing the cavity 111. However, in both the open and closed states, the housing 110 includes an opening 112 which provides a passageway between the cavity 111 and an external environment. The cover 120 includes a shaft 124 rotatably connected to the second end 122 of the cover 120.

The automated cover opening apparatus 101 further includes a first biasing member 113 in operable communication with both the housing 110 and the cover 120. The first biasing member 113 applies a force onto the cover 120 such that the cover 120 is biased toward the open state. In an exemplary embodiment, the first biasing member 113 is a torsion spring, but the present invention is not limited thereto.

Still referring to FIG. 1, the drive system assembly 130 includes a platen 131 attached to one end of the shaft 124, a platen drive roller 132 attached to another end of the shaft 124 such that the platen 131 co-rotates with the platen drive roller 132, a drive motor 133 fixedly secured within the cavity 111 of the housing 110, and an idler roller 134. The drive motor 133 includes a drive shaft 135, having a rotational axis, and a drive roller 136 attached to the drive shaft 135. In exemplary embodiments, the drive roller 136 is attached to be concentric with the drive shaft 135. In an exemplary embodiment, the platen 131 is an elongated cylindrical rubber roller. In further exemplary embodiments, the drive roller 136 includes a motor pinion gear.

The idler roller 134 is positioned within the cavity 111 to contact to the platen drive roller 132, which is rotatably attached to the second end 122 of the cover 120. The platen drive roller 132 is driven by a rotation of the idler roller 134 when the platen drive roller 132 is in contact with idler roller 134. The platen drive roller 132 and the platen 131 are supported by the shaft 124 connected to the second end 122 of the cover 120. The platen drive roller 132 co-rotates with the shaft 124 and the platen 131, such that the platen 131 is also driven by the rotation of the idler roller 134. That is, a rotation of the platen drive roller 132 and the platen 131 correspond to a rotation of the idler roller 134. The idler roller 134, in turn, is rotated by a drive roller 136.

The idler roller 134 is attached to the drive motor 133 by a link member 137. A first end of the link member 137 is pivotally attached to the drive motor 133. A second end of the link member 137 is rotatably connected to the idler roller 134. The link member 137 is configured to freely rotate with respect to a rotational axis of a drive shaft 135 of the drive motor 133, which is referred to as link member pivot 138 in FIG. 1. In addition, a rotation of the platen 131 and the platen drive roller 132 correspond to a rotation of the drive motor 133. Furthermore, a rotational direction of the link member 137 corresponds to a rotational direction of the drive motor 133. That is, in exemplary embodiments, when the drive shaft 135 of the drive motor 133 rotates in a first direction 139, the idler roller 134 rotates in a second direction 140, which thereby drives the platen drive roller 132 to rotate in the first direction 139. In an exemplary embodiment, as illustrated in FIG. 1, the first direction 139 is a counter-clockwise direction, and the second direction 140 is a clockwise direction.

In an exemplary embodiment, the automated cover opening apparatus 101 includes a paper roll 171 rotatably supported within the cavity 111 such that paper from the paper roll 171 is allowed to feed in between the platen 131 and the thermal print head/heat sink assembly 160 toward the external environment via the opening 112, when the drive motor 133 operates in the first direction 139.

Still referring to FIG. 1, the first stop 150 is positioned such that the link member 137 rests on a surface of the first stop 150 during a normal operation of the POS printer 100, and the second stop 151 is positioned apart from the first stop 150, such that the link member 137 is capable of a rotation, with respect to the link member pivot 138, between the first and second stops 150 and 151, respectively.

The thermal print head/heat sink assembly 160 includes a heat sink 161, a thermal print head 162 attached to a first surface of the heat sink 161 and a second biasing member 163. The heat sink 161 further includes a cover detent feature 164 which protrudes from the first surface of the heat sink 161. The second biasing member 163 applies a force onto the cover detent feature 164 and also provides a pressure necessary for thermal printing. In exemplary embodiments, the cover detent feature 164 includes a circular shape and the second biasing member 163 is a spring. The thermal print head/heat sink assembly 160 is movably attached within the cavity 111 of the housing 110, such that a location of the cover detent feature 164 is altered by a force applied thereon.

The platen 131 includes bearings (not shown) which rest on frame members (not shown) of the POS printer 100. The bearings limit a rotation of the cover 120 and maintain an alignment of the platen 131 to the thermal print head 162. In exemplary embodiments, the bearings limit a clock-wise rotation of the cover 120. The cover detent feature 164 is disposed above the thermal print head 162. The thermal print head/heat sink assembly 160 is disposed such that the platen 131 is in contact with a surface of the thermal print head 162, and the cover detent feature 164 is disposed above a rotational axis of the platen 131, when the cover 120 is in the closed state. As illustrated in FIG. 1, the thermal print head/heat sink assembly 160 is biased in a direction toward the platen 131 by the second biasing member 163. Thereby, the cover detent feature 164 secures the platen 131 and the cover 120 in the closed state. The thermal print head/heat sink assembly 160 is maintained in contact with the platen 131 by the second biasing member 163.

Figure 2:
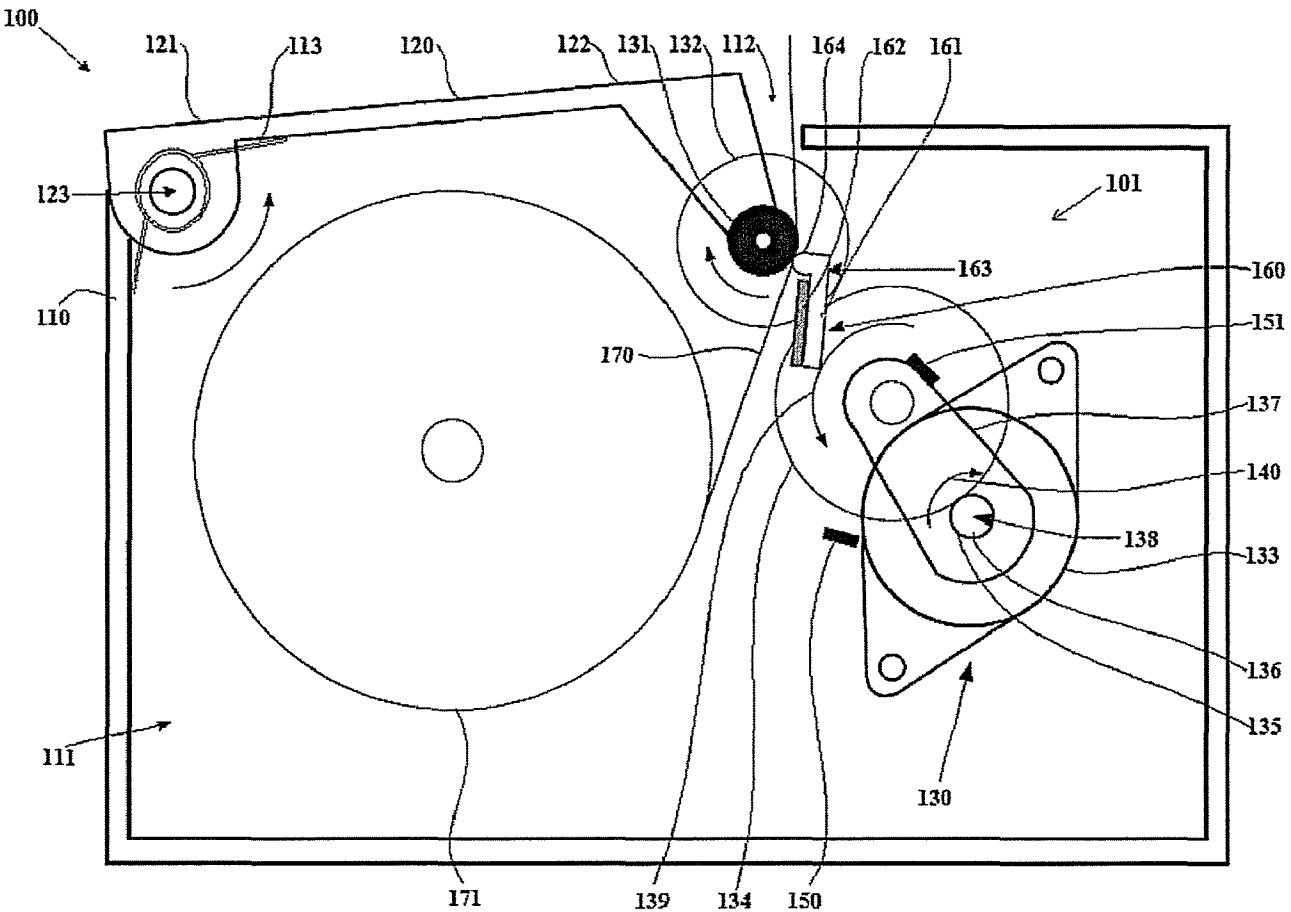
FIG. 2 is a partial cross-sectional schematic diagram illustrating a side view of the exemplary embodiment of a POS printer including an automated cover opening apparatus, in an open state, in accordance with the present invention.

FIG. 1 illustrates a cross-sectional schematic diagram view of a POS printer housing 110 in order to more clearly depict the automated cover opening apparatus disposed therein. The first end 121 of the cover 120 is pivotally attached to the housing 110 at cover pivot 123. The first biasing member 113 is operably communicated with the housing 110 and the cover 120 such that the first biasing member 113 applies a force onto the cover 120 to drive the cover 120 toward the open state, as illustrated in FIG. 2. That is, the first biasing member 113 applies a force in order to drive the cover 120 toward the open state, when there are no opposing forces applied onto the cover 120. In an exemplary embodiment, the first biasing member 113 includes a torsion spring, but the present invention is not limited thereto.

During a closing operation of the cover 120, the platen 131 applies a force onto the thermal print head/heat sink assembly 160 in order to deflect the cover detent feature 164 and thereby allow the platen 131 to roll pass. Thereafter, the second biasing member 163 forces the cover detent feature 164 against the platen 131, thereby securing the cover 120 and completing the closing operation of the cover 120.

In a normal operation of the POS printer 100, the platen 131 advances paper 170 dispensed on a paper roll 171 toward an exterior of the POS printer 100 by rotating in the first direction 139, such as a counter-clockwise direction, as illustrated in FIG. 1. The drive motor 133 rotates in the first direction 139 (e.g., a forward direction) which drives the drive roller 135 to rotate the idler roller 134 in the second direction 140, such as a clockwise direction, which in turn, causes the platen drive roller 132 and the platen 131 to rotate in the first direction 139, thereby advancing the paper 170 from the paper roll 171 in between the platen 131 and thermal print head/heat sink assembly 160.

In addition, during the normal operation of the POS printer 100, a net force is created by the advancement of the paper and the rotation of the idler roller 134 and the platen drive roller 132, which results in a clockwise moment created on the cover 120 with respect to the cover pivot 123, to further maintain the cover 120 in the closed state.

FIG. 2 is a partial cross-sectional schematic diagram illustrating a side view of the POS printer including an automated cover opening apparatus, wherein the cover 120 is in an open state.

During an opening operation of the cover 120, the drive motor 133 rotates in the second direction 140 (e.g., a reverse direction) which thereby drives the drive roller 135 to rotate the idler roller 134 in the first direction 139, which in turn, causes the platen drive roller 132 and the platen 131 to rotate in the second direction 140. The rotation of the platen 131 in the second direction 140 causes the platen 131 to attempt to recoil previously advanced paper 170. However, due to a significant amount of friction between the thermal print head/heat sink assembly 160 and the paper 170, the paper 170 remains stationary and the platen 131 begins to climb over the cover detent feature 164. Thereafter, the rotation of the drive motor 133 in the second direction 140 (e.g., the reverse direction) creates forces onto the idler roller 134 which forces the link member 137 to rotate from the first stop 150 toward the second stop 151. As the link member 137 rotates, the idler roller 134 attached thereto, is elevated toward the cover 120 such that the platen drive roller 132 and the idler roller 134 remain in contact with each other until the platen 131 completely climbs over the cover detent feature 164. However, when the idler roller 134 and the platen drive roller 132 separate from each other, the link member 137 rotates back toward the first stop 150, so that a normal operation of the POS printer can resume when the cover 120 is returned to the closed state. In exemplary embodiments, the link member 137 is rotated back toward the first stop 150 by gravity, a torsion spring (not shown), or by temporarily activating the drive motor 133. In further exemplary embodiments, the drive motor 133 is coupled to the cover 120, for example, such that a link member 137 is not required.

The description above illustrates a simple mechanism that will open the cover 120 when the drive motor 133 is operated in a second direction (e.g., a clockwise direction). In exemplary embodiments, the drive motor 133 may be reversed by a signal from a switch or by a system command.

The cover 120 may be manually opened in the event of an electrical failure or when the POS printer is not connected to the system command. Exemplary embodiments of the automated cover opening apparatus 101 according to the present invention provide differentiating features for the POS printer, simplify the paper supply roll loading process, improve a reliability of the POS printer and reduce a cost of the POS printer.

While the preferred embodiments to the invention have been described, it will be understood that those skilled in the art, both now and in the future, may make various improvements and enhancements which fall within the scope of the claims which follow. These claims should be construed to maintain the proper protection for, the invention first described.

What is claimed is:

1. A point of sale printer comprising:

a housing defining a cavity;

a cover including a first end and a second end, the first end of the cover pivotally coupled to the housing;

a first biasing member in operable communication with the housing and the cover, the first biasing member biasing the cover in a direction toward an open state;

a shaft rotatably connected to the second end of the cover;

a thermal print head including a heat sink, a cover detent feature and a second biasing member, the cover detent feature secures the cover to the housing in a closed state and the second biasing member biasing the cover detent feature;

a platen attached to the shaft;

a platen drive roller attached to one end of the shaft such that the platen drive roller co-rotates with the platen;

a drive motor including a drive shaft having a rotational axis, the drive motor fixedly secured within the cavity of the housing;

a drive roller attached to the drive shaft of the drive motor;

a link member including a first end and a second end, the first end of the link member rotatably attached to the drive shaft, the link member configured to rotate about the rotational axis of the drive motor; and an idler roller rotatably connected to the second end of the link member, the idler roller configured to be in physical communication with the platen drive roller and the driver roller, wherein a first rotational direction of the drive shaft corresponds to a first rotational direction of the link member, which in turn corresponds to a normal, paper advancement operation of the printer and rotation of the idler roller, which maintains the cover in a closed state, and wherein a second rotational direction of the drive shaft corresponds to a second rotational direction of the link member, which in turn, corresponds to an elevation of the idler roller which allows the platen to force the cover detent feature to release the cover.

2. The point of sales printer of claim 1, wherein the cover detent feature includes a circular shape.

3. The point of sales printer of claim 1, wherein the platen is a rubber roller.

4. The point of sales printer of claim 1, wherein the platen includes an elongated cylindrical shape.

5. The point of sales printer of claim 1, wherein the drive roller includes a motor pinion gear.

6. The point of sales printer of claim 1, wherein the first biasing member is a spring.

7. The point of sales printer of claim 1, wherein the second biasing member is a spring.

8. The point of sales printer of claim 1, wherein the drive shaft, the platen drive roller and the link member rotate in an opposite direction with respect to the idler roller.

* * * * *